US005238412A

United States Patent [19]

Morishita et al.

[11] Patent Number: 5,238,412

[45] Date of Patent: Aug. 24, 1993

[54] SURFACE MOUNT CONNECTOR

[75] Inventors: Yoshimasa Morishita; Takayasu Onoda, both of Yokohama, Japan

[73] Assignee: Nippon Acchakutanshi Seizo Kabushiki Kaisha, Osaka, Japan

[21] Appl. No.: 897,771

[22] Filed: Jun. 12, 1992

[30] Foreign Application Priority Data

Jun. 14, 1991 [JP] Japan ..... 3-53678[U]

[51] Int. Cl.[5] ..... H01R 9/09

[52] U.S. Cl. ..... 439/79; 439/83

[58] Field of Search ..... 439/76, 79-83

[56] References Cited

U.S. PATENT DOCUMENTS

| | | | |
|---|---|---|---|
| 4,392,705 | 7/1983 | Andrews, Jr. et al. | 439/79 |
| 4,659,155 | 4/1987 | Walkup et al. | 439/79 |
| 4,903,402 | 2/1990 | Norton et al. | 439/79 |
| 5,085,601 | 2/1992 | Buchter et al. | 439/79 |
| 5,106,313 | 4/1992 | Lwee et al. | 439/79 |
| 5,133,670 | 7/1992 | Doi et al. | 439/79 |
| 5,186,633 | 2/1993 | Mosser, III | 439/79 |

*Primary Examiner*—Paula A. Bradley

*Attorney, Agent, or Firm*—Antonelli, Terry, Stout & Kraus

[57] ABSTRACT

A surface mount connector including an insulating housing and pairs of an upper and lower pin contacts which comprising terminal pins piercing the housing and being in vertical alignment and partially in a bifurcated pattern, in each pair. Each pin contact has a lead 15A or 15B integral with its base portion 15A or 15B and solderable to a pad on a printed circuit board. The leads are included in a single plane intermediate two further planes in which the upper and lower terminal pins respectively, respectively extend, respectively. A bottom contact surface of each lead protrudes downwardly between stepped regions of the lead. The insulating housing is partially cut off at its lower corner under the leads so as to provide a cutout tightly engageable with a side edge of the printed circuit board, so that visual inspection and correcting of soldered leads of the connector is facilitated, while ensuring reliable soldering of the leads, and further reducing the size and height of the connector from the board.

5 Claims, 5 Drawing Sheets

SURFACE MOUNT CONNECTOR

BACKGROUND OF THE INVENTION

1. Field of the Invention

The present invention relates to a surface mount connector mounted on a surface of printed circuit board, and more particularly, to a surface mount connector adapted to electrically connect a highly integrated electronic device such as a hard disc drive unit, IC memory card or the like to another device, wherein the drive unit and the memory card comprise a plurality of input and output pins or terminals.

2. Description of Prior Art

The number of input and output terminals of an integrated electronic device may, for example, be fifty to sixty-eight, with their contacts being disposed one above another to form two rows. Therefore, a pin header of the prior art surface mount connector for connection with such a device comprises a plurality of pairs of pin contacts 2 in a manner shown in FIGS. 9 and 10. They are arranged vertically and in two rows, wherein an upper pin contact 2A in each pair has a terminal pin 3 extending through an insulating housing 1 and located above another terminal pin 3 of a lower pin contact 2B. Leads 4A and 4B are respectively formed at the opposite end of the terminal pins 3. The lead 4A of the upper pin contact 2A in each pair has a length greater than a length of the other lead 4B of the lower pin contact 2B. Thus, the leads 4B of all the pairs form a inner row, and the other leads 4A form an outer row so that two rows of those leads are soldered to pads 33 on a printed circuit board 31.

It will however be noted that the soldered lead 4B of lower pin contact 2B in each pair is positioned behind the adjacent lead 4A of the upper pin contact 2A. This renders it difficult to perform the visual inspection of the soldered state of the inner leads 4B. Correction work for correcting any incorrectly soldered inner leads is also not easy.

On the other hand, the outer leads 4A extending beyond the inner leads 4B occupy an undesirably large area on a surface of the printed circuit board. Further, because the pin contacts 2A and 2B vertically disposed through the housing 1, the housing requires a height such that the connectors of this type cannot be made smaller and thinner.

SUMMARY OF THE INVENTION

An object of the present invention is therefore to provide a surface mount connector which is free from the disadvantages encountered in the prior art connectors.

According to the present invention, a surface mount connector comprises an insulating housing, pairs of pin contacts each comprising a terminal pin piercing the insulating housing, with the terminal pins in each pair being located in vertical alignment with one another and partially in a bifurcated pattern, leads each formed integral with a base portion of each terminal pin so as to have a bottom contact surface solderable to a pad on a printed circuit board, and the leads being included in a single horizontal plane at a height intermediate two further horizontal planes in which the upper terminal pins and the lower terminal pins are included, respectively, wherein the bottom contact surface protrudes downwardly between stepped regions, and the insulating housing is partially cut off at its lower corner portion under the leads so as to provide a cutout tightly engageable with a side edge of the printed circuit board.

In order for the abovementioned leads to form a single row, preferably, the lead of each upper pin contact is offset a distance in a lateral direction from an axis of its terminal pin and is bent downwardly. Correspondingly, the other lead of each lower pin contact will be offset the same distance from an axis of its terminal pin, but in a reverse direction opposite to the lateral direction mentioned above, and is bent upwardly. The offset distance may be a fourth of the pitch of the terminal pins.

Although the terminal pins are vertically arranged in two rows, the leads integrally extending therefrom do form the single row thereof so that they can be bonded to the pads on the printed circuit board by solder. The stepped regions defining the protruding bottom surface of each lead will permit the molten solder to readily flow between the bottom surface and an upper surface of the circuit board, whereby the leads are rigidly joined thereto. With the cutout housing being set to engage with the edge of the circuit board, the portion of the housing engaging with and holding the terminal pins of lower pin contacts is positioned much lower than the upper surface of the printed circuit board, thus remarkably reducing an effective overall height thereof.

It will now be apparent that the surface mount connector, which comprise a single row of leads extending from an upper and lower rows of terminal pins, is advantageous in the following points. At first, the visual inspection of the leads soldered to pads on a printed circuit board can be carried out easily. Also, an incorrect soldering of the leads can be corrected without any difficulty. Due to the cutout region of the connector being fittable on a circuit board edge, its portion holding the lower terminal pins is disposed lower relative to the circuit board. This remarkably decreases an overall height inclusive of the connector and thus to render it smaller-sized and thinner. A molten solder quickly filling the stepped regions beside the protruding bottom of each lead will firmly fix the leads on the circuit board, to provide a firmly soldered connection. In spite of a cantilevered state of the connector attached to the board and a considerably strong bending stress or torsion imparted to this connector when coupled with another connector, such a firm connection will not be broken to impair a reliability thereof. In a case wherein reinforcing pins are formed at both sides of the housing, the reinforcing pins will further improve the strength and reliability of the soldered connection.

BRIEF DESCRIPTION OF THE DRAWINGS

Embodiments of the invention will now be described referring to the accompanying drawings, in which.

DETAILED DESCRIPTION OF PREFERRED EMBODIMENTS

Figure 1:
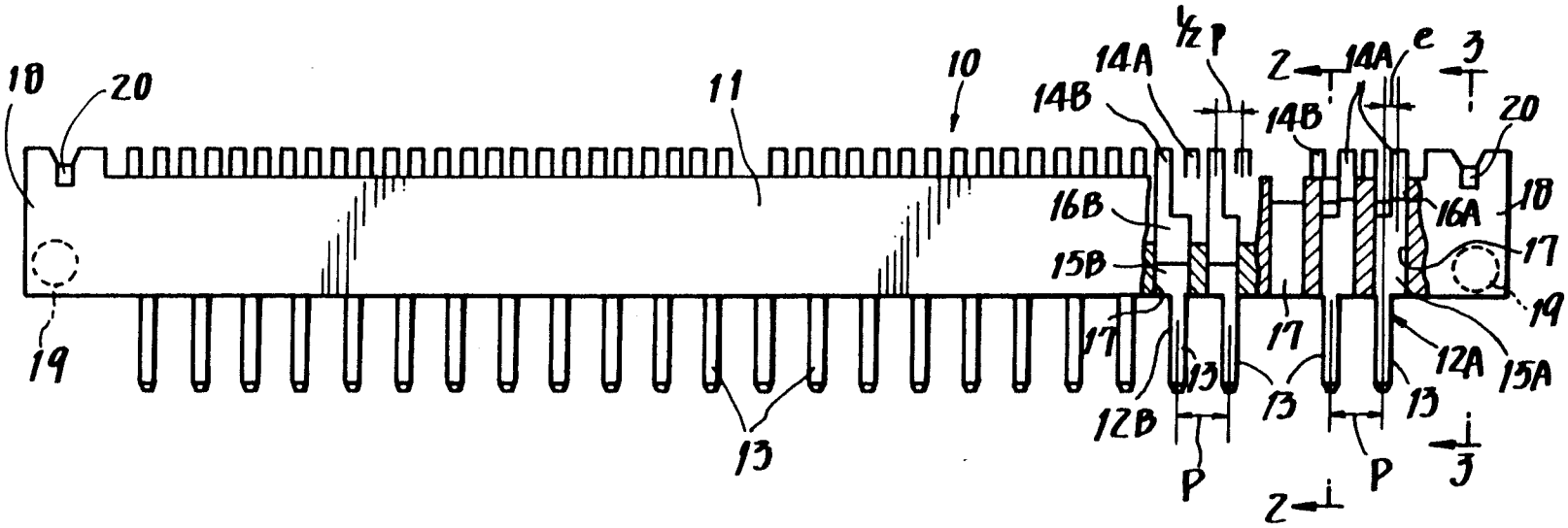
FIG. 1 is a plan view showing, partially in cross section, a pin header in which the present invention on a surface mount connector constructed in accordance with the present invention.
Figure 2:
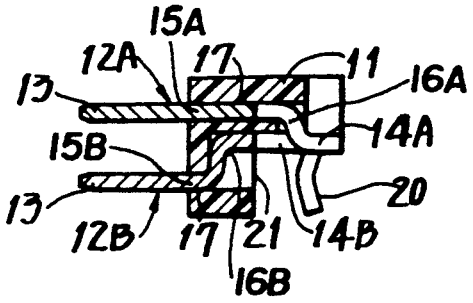
FIG. 2 is a cross sectional view taken along the line 2—2 in FIG. 1.
Figure 3:
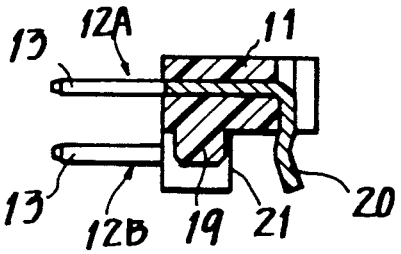
FIG. 3 is a cross sectional view taken along the line 3—3 in FIG. 1.

FIGS. 1 to 3 illustrate a pin header 10 as one of surface mount connectors which may be provided by the invention, the pin header being connected, for example, to a hard disc drive unit.

The pin header 10 comprises an insulating housing 11, a plurality of, for example, twenty-four upper pin contacts 12A, and a plurality of, for example, twenty-three lower pin contacts 12B. These pin contacts, having terminal pins 13 as their integral portions penetrating the insulating housing 11, are vertically arranged in two rows and at a constant pitch P, for example, 2.00 mm, with a few contacts being omitted for the sake of clarity.

The terminal pins 13 of the upper pin contacts 12A are of the same shape and the same dimension as the terminal pins 13 of the lower pin contacts 12B. Leads 14A and 14B which are soldered as described later are integral with base portions 15A and 15B of the upper and lower terminal pins 13, but taking different spatial positions relative to the base portions.

Figure 4:
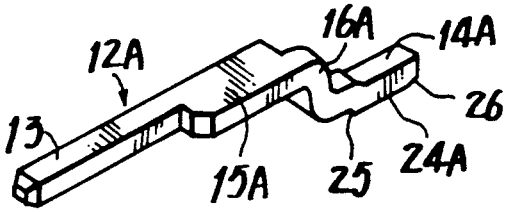
FIG. 4 is a perspective view of an upper pin contact constructing the pin header.

As shown in FIG. 4, each upper pin contact 12A has an intermediate portion 16A which extends from the base portion 15A of the terminal pin 13 and is bent downwardly. Each upper pin contact 12A further has the lead 14A which extends from the intermediate portion substantially in parallel with the the terminal pin 13. Such a lead 14A and the intermediate portion 16A are offset from an axis of the terminal pin 13 by a distance e, in a direction along which the row of these pins extends. This distance e perpendicular to the axis of each pin, is equal to a one fourth of the pitch P (FIG. 1). A bottom contact surface 24A of each lead 14A extends downwardly between the stepped regions 25 and 26. This shape is effective, as described later, to improve the junction strength between the lead 14A and a printed circuit board 31.

Figure 5:
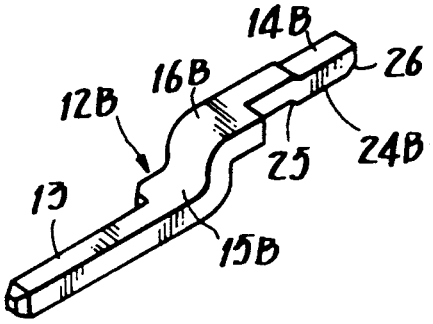
FIG. 5 is an exploded perspective view of a lower pin contact constructing the pin header.

On the other hand, each lower pin contact 12B has an intermediate portion 16B which extends from the base portion 15B of the terminal pin 13 and is bent upwardly, as shown in FIG. 5. Each lower pin contact 12B similarly has the lead 14B extending from the intermediate portion substantially in parallel with the the terminal pin 13. These leads 14B and intermediate portion 16B are offset from the axis of the terminal pin 13 by the distance e, in another direction, opposite to that direction for the upper pin contacts 12A, in which the row of lower pin contacts extends. The distance e for those lower pin contacts is also equal to one fourth of the pitch P (FIG. 1). Similarly to the bottom surface of the lead 14A, a bottom contact surface 24B of each lead 14B extends downwardly between the stepped regions 25 and 26.

As shown in FIG. 2, the base portions 15A and 15B of the upper and lower pin contacts 12A and 12B are inserted and secured in upper and lower apertures 17 which penetrate the housing 11. The terminal pins 13, which are integral with the thus secured contacts 12A and 12B, extend forwardly from a front surface of the housing so that they are arranged in an upper and lower rows at the pitch P. All the leads 14A and 14B protruding rearwardly from a back surface of the housing 11 form a single row at a height intermediate the upper and lower rows of the terminal pins 13. The leads are arranged at a pitch of ½ P.

Figure 6:
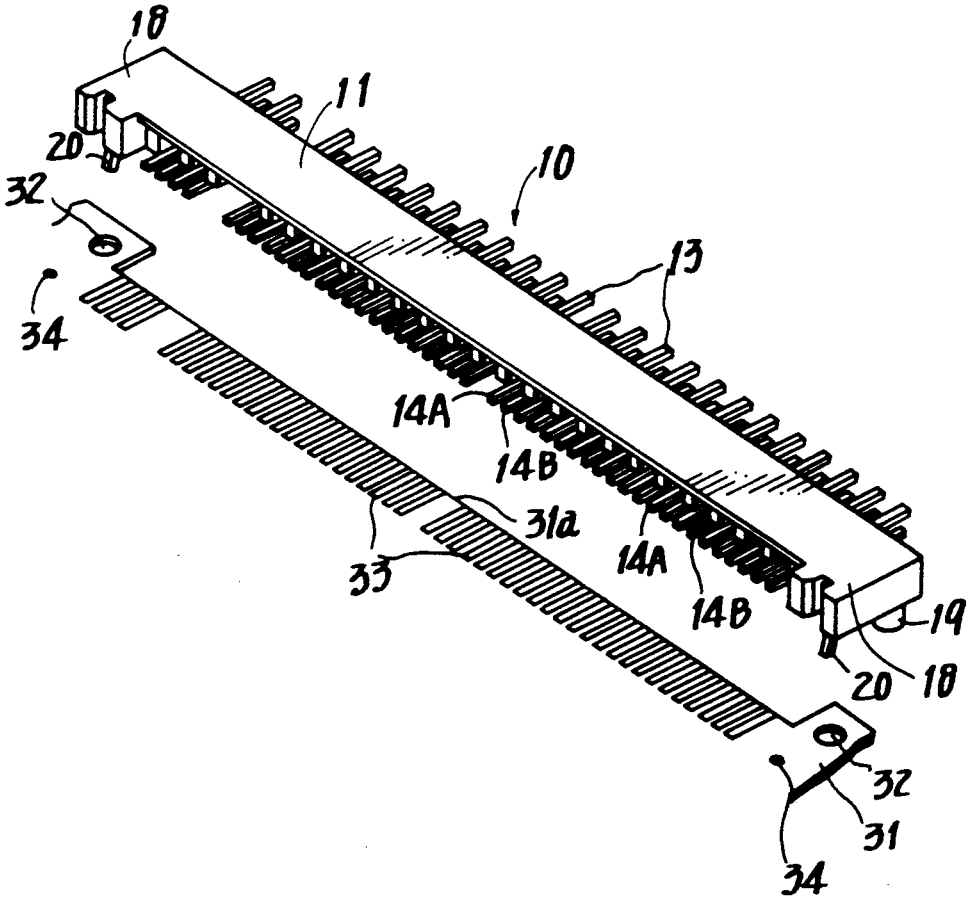
FIG. 6 is a perspective view of the pin header in use.

The insulating housing 11 is a flat and elongated parallelepiped made of an insulating material such as glass-reinforced polyamide resin, polyphenylene sulfide resin, for example, PPS or polyphenylene oxide resin, for example, NOPYL. Short arms 18 protrude rearwardly from both side ends of the housing 11. A boss 19 extends downwardly from a forward portion of each arm 18, and an L-shaped reinforcing pin 20 is fixedly inserted in and protrude from a rear portion of the arm (FIG. 3). The bosses 19 fit in side openings 32 of the printed circuit board 31 so as to facilitate a correct positioning of this pin header on the circuit board (FIG. 6). The reinforcing pins 20 engage with further openings 34 of the printed circuit board so that the pin header can stably stand thereon in its temporarily assembled state. Projecting ends of the pins 20 are soldered to a lower surface of the board 31 (FIG. 7), whereby the pin header 10 is protected from a torsion which may be imparted to the housing 11 after being soldered to the circuit board 31.

On the other hand, a rear portion of the insulating housing 11 is partially cut off at its lower corner under the leads 14A and 14B, to provide a square cross-section cutout 21. This cutout 21 is of such a shape as to fit on a forward edge 31*a* of the printed circuit board 31.

Figure 7:
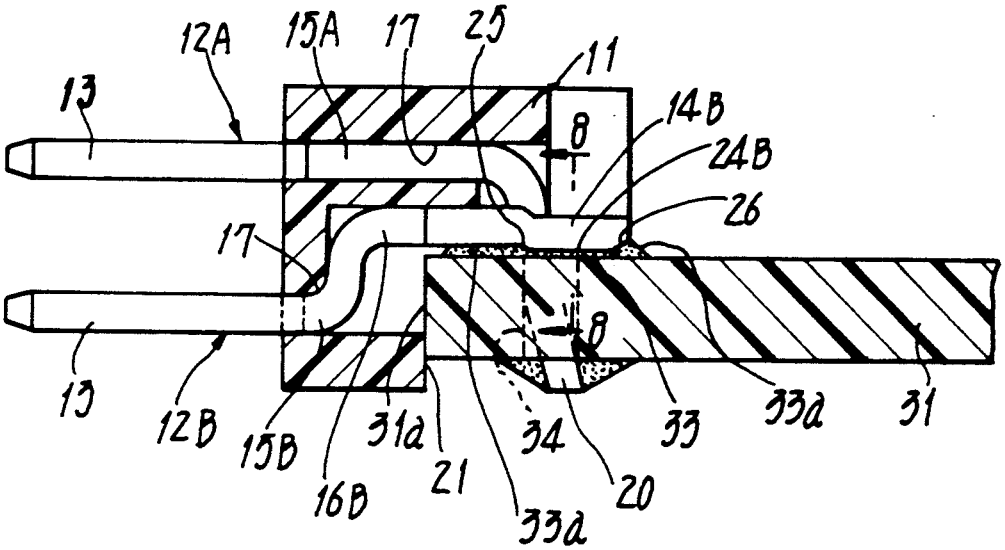
FIG. 7 is an enlarged cross sectional view of the surface-mounted pin header.
Figure 8:
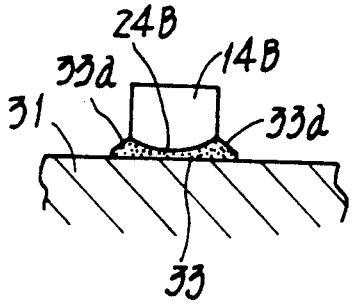
FIG. 8 is a cross sectional view taken along the line 8—8 in FIG. 7.
Figure 9:
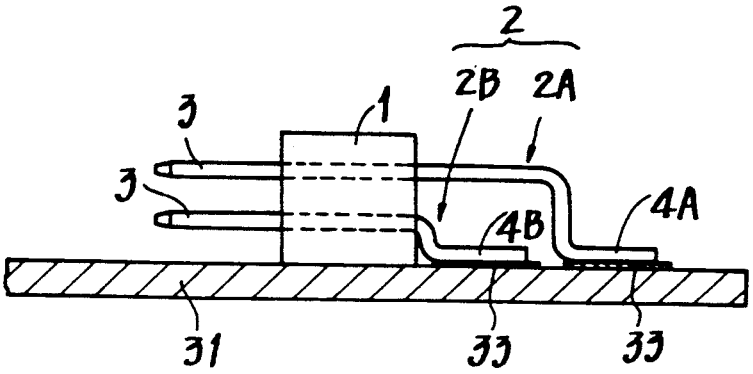
FIG.9 PRIOR ART
FIG. 9 is a partial cross-sectional front elevation of a prior art surface mount connector.
Figure 10:
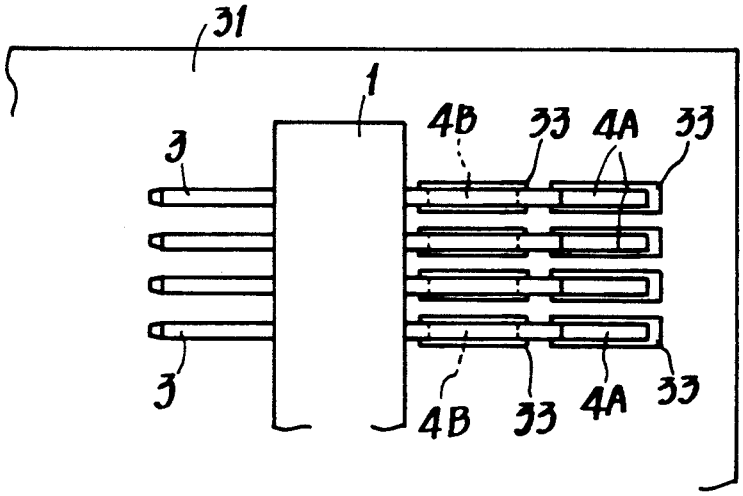
FIG.10 PRIOR ART
FIG. 10 is a plan view of the prior art connector of FIG. 9.

As shown in FIGS. 6 and 7, the pin header 10 having a structure as described above is set on the printed circuit board 31, with its forward edge 31*a* engaging with the cutout 21 of the housing 11. When the leads 14A, 14B in the single row are then soldered to pads 33 formed on the circuit board 31, a molten soldering agent 33*a* fills the spaces which are defined with the stepped regions 25, 26 ahead and behind each bottom contact surfaces 24A 24B of the leads 14A 14B. Such a filling of the soldering agent improves the connection strength of the housing soldered to the printed circuit board. Further, the bottom surfaces 24A, 24B may be of a convex shape as shown in FIG. 8 so as to receive a larger amount of the soldering agent 33*a* and thereby increase further the soldered strength of said leads 14A, 14B.

In use, the terminal pins 13 arranged to form the upper and lower rows will be accommodated in sockets of a female connector (not shown) to provide an electric connection. In this state of the surface mount connector provided by the present invention, its portion having the terminal pins 13 of lower pin contacts 12 will be positioned below the surface of the circuit board 31, thus reducing its height from the surface of the circuit board 31.

What is claimed is:

1. A surface mount connector comprising:

an insulating housing;

pairs of pin contacts, each pin contact comprising a terminal pin piercing the insulating housing, the terminal pins including upper terminal pins and lower terminal pins in each pair being located in vertical alignment with one another and partially in a bifurcated pattern;

leads each formed integral with a base portion of each terminal pin, the leads being disposed in a single horizontal plane at a height intermediate two further horizontal planes in which the upper terminal pins and the lower terminal pins are respectively included, and wherein the insulating housing is partially cut off at a lower corner portion thereof under the leads so as to provide a cutout tightly engageable with a side edge of a printed circuit board.

2. A surface mount connector comprising:

an insulating housing;

pairs of pin contacts, each pin contact comprising a terminal pin piercing the insulating housing, the terminal pins including upper terminal pins and lower terminal pins in each pair being located in vertical alignment with one another and partially in a bifurcated pattern;

leads each formed integral with a base portion of each terminal pin and comprising a bottom contact surface adapted to be soldered to a pad on a printed circuit board, the bottom contact surface extending downwardly from each lead between stepped regions thereof, the leads being disposed in a single horizontal plane at a height intermediate two further horizontal planes in which the upper terminal pins and the lower terminal pins are respectively included, and wherein the insulating housing is partially cut off at a lower corner portion thereof under the leads so as to provide a cutout tightly engageable with a side edge of the printed circuit board.

3. A surface mount connector according to one of claims 1 or 2, wherein the lead of each upper pin contact is offset by a distance in a lateral direction from an axis of its terminal pin and is bent downwardly, and the other lead of each lower pin contact is offset the same distance from an axis of its terminal pin, but in a reverse direction opposite to the lateral direction in which the lead of the upper pin contact is offset.

4. A surface mount connector as defined in claim 3, further comprising L-shaped reinforcing pins inserted through and fixed in end portions of the insulating housing.

5. A surface mount connector according to one of claims 1 or 2, further comprising L-shaped reinforcing pins inserted through and fixed in end portions of the insulating housing.

* * * * *